US005152270A

United States Patent [19]

Miyamoto

[11] Patent Number: 5,152,270

[45] Date of Patent: Oct. 6, 1992

[54] AUTOMOTIVE ENGINE CONTROL SYSTEM

[75] Inventor: Koji Miyamoto, Higashihiroshima, Japan

[73] Assignee: Mazda Motor Corporation, Hiroshima, Japan

[21] Appl. No.: 765,367

[22] Filed: Sep. 25, 1991

[30] Foreign Application Priority Data

Sep. 26, 1990 [JP] Japan ..... 2-256540

[51] Int. Cl.[5] ..... F02D 41/14

[52] U.S. Cl. ..... 123/692; 123/488

[58] Field of Search ..... 123/488, 440, 489, 494; 73/118.2; 364/431.05

[56] References Cited

U.S. PATENT DOCUMENTS 4,561,400 12/1985 Hattori ..... 123/440 X 5,007,399 4/1991 Nakaniwa ..... 123/489

FOREIGN PATENT DOCUMENTS 1-777435 7/1989 Japan .

*Primary Examiner*—Tony M. Argenbright

*Attorney, Agent, or Firm*—Fleit, Jacobson, Cohn, Price, Holman & Stern

[57] ABSTRACT

An engine control system for an internal combustion engine is equipped with dual air-fuel ratio feedback control systems for feedback controlling air-fuel ratios for two groups of injectors. The system includes a common air flow rate sensor, common to both groups, for detecting a common air flow rate introduced into the cylinders and an individual air-fuel ratio sensor for each group of injectors for determining an air-fuel ratio related value for its respective air-fuel ratio feedback control system. A feedback correction value for correction of fuel injection is determined from the air-fuel ratio ralated values for each air-fuel ratio feedback control system. An air flow rate is corrected based on the feedback correction values for correction of fuel injection for the dual air-fuel ratio feedback control systems. Virtual fuel injection rates for the two groups of injectors are then determined from the corrected air flow rate.

6 Claims, 4 Drawing Sheets

BASIC FUEL INJECTION RATE

| | ENGINE SPEED | | | | | |
|---|---|---|---|---|---|---|
| INTAKE AIR FLOW RATE | — | — | — | — | — | — |
| | — | — | — | — | — | — |
| | — | — | — | — | — | — |
| | — | — | — | — | — | — |
| | — | — | — | — | — | — |
| | — | — | — | — | — | — |

AUTOMOTIVE ENGINE CONTROL SYSTEM

BACKGROUND OF THE INVENTION

1. Field of the Invention

The present invention relates to an engine control system and, more particularly, a control system for an internal combustion automotive engine equipped with two air-fuel ratio feedback control systems for controlling fuel injection rates for two groups of fuel injectors independently.

2. Description of Related Art

Some internal combustion engines are equipped with two air-fuel ratio feedback control systems. Such internal combustion engines, which typically are V-type internal combustion engines, are usually provided with one air-fuel ratio sensor in the exhaust system for each of a pair of cylinder banks. The air-fuel ratio for cylinders of each bank is controlled by a signal from another air-fuel ratio sensor. Such an automotive engine control system is known from, for instance, Japanese Unexamined Patent Publication No. 1-177,435.

In such a V-type internal combustion engine, it is common to provide an air flow meter for detecting the air flow rate of intake air in an air intake passage common to both of the cylinder banks. A basic injection rate of fuel is established for an injector of each bank on the basis of an air flow rate detected by the air flow meter. A feedback correction value relating to the basic injection rate for the injector of each cylinder bank is determined from the air-fuel ratio detected by the air-fuel ratio sensor of the bank.

A control system of this type, however, may have a problem in that the intake air flow meter may incorrectly determine intake air flow rates due, for example, to deterioration with time or to aging. As a result, the basic injection rate of the fuel itself, which is established on the basis of an incorrectly determined intake air flow rate, is incorrect, and the air-fuel ratio feedback control system is subjected to large demands in order to compensate for the incorrectly determined intake air flow rate.

SUMMARY OF THE INVENTION

It is, therefore, a primary object of the present invention to provide an automotive engine control system which rationalizes the determination of intake air flow rate by an air flow detection means and mitigates demands or load on the air-fuel ratio feedback control system The primary object of the present invention is accomplished by providing an engine control system for an internal combustion engine which is equipped with first and second air-fuel ratio feedback control systems for feedback controlling air-fuel ratios for first and second groups of injectors provided in two cylinder banks, respectively. The engine control system comprises a common air flow rate detecting means for the first and second cylinder groups, and first and second air-fuel ratio sensors provided individually for the first and second cylinder groups. The air-fuel ratio sensors detect an air-fuel ratio of a fuel mixture introduced into the cylinders. Each air-fuel ratio sensor determines a value concerning an air-fuel ratio for feedback correction of an air-fuel ratio performed by one of the air-fuel ratio feedback control systems. The engine control system further comprises a control unit. The control unit determines feedback correction values of fuel injection, based on air-fuel ratio related values, necessary to perform feedback corrections by the first and second air-fuel ratio feedback control systems. The control unit further obtains a mean feedback correction value of the feedback correction values of fuel injection for the first and second air-fuel ratio feedback control systems, performs a correction of the air flow ratio based on the mean feedback correction value, and then determines virtual fuel injection rates for the first and second groups of injectors, based on the corrected air flow rate.

According to a specific embodiment of the present invention, each air-fuel ratio sensor means comprises a sensor for detecting the emission level of oxygen in exhaust gases. The mean feedback correction value includes an arithmetic average of a predetermined number of feedback correction values for fuel injection for the first and second air-fuel ratio feedback control systems.

In the engine control system of the present invention, because a flow rate of intake-air detected by the common air-flow rate detecting means is corrected using the mean feedback correction value, which, in turn, is an arithmetic average of a predetermined number of the feedback correction values of fuel injection for the first and second air-fuel ratio feedback control systems, a basic control value, such as a basic fuel injection value, is properly determined

BRIEF DESCRIPTION OF THE DRAWINGS

The above and other objects and features of the present invention will be apparent to those skilled in the art from the following description of a preferred embodiment thereof when considered in conjunction with the drawings, in which.

DESCRIPTION OF THE PREFERRED EMBODIMENT

Figures 1, 2:
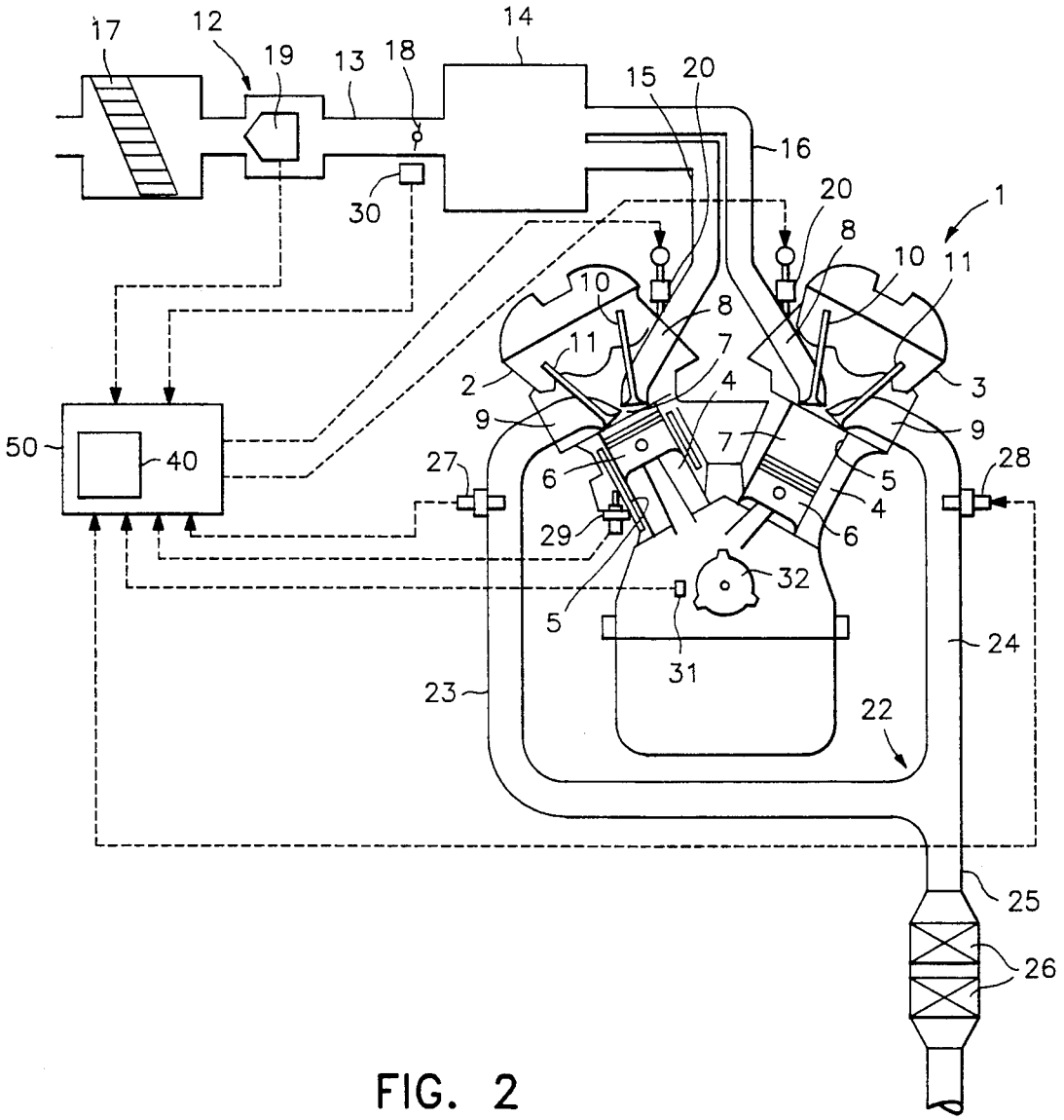
FIG. 1 is a diagram of an engine control system in accordance with a preferred embodiment of the present invention.
FIG. 2 is a map of the basic fuel injection rate.

Referring to the drawings in detail, and in particular, to FIG. 1, an engine body 1 of, for example, a V-type, six-cylinder internal combustion engine, equipped with an engine control system in accordance with a preferred embodiment of the present invention, is shown. The engine body includes a left cylinder bank 2 and a right cylinder bank 3, each bank 2 or 3 being equipped with three cylinders 4. Each cylinder 4 has a cylinder bore 5, in which a piston 6 slides or reciprocates up and down, an intake port 8, and an exhaust port 9. Both the intake port 8 and the exhaust port 9 open into a combustion chamber 7, defined by the top surface of the piston 6 and the cylinder bore 5. The intake port 8 and the exhaust port 9 of each cylinder 4 are opened and shut at a predetermined timing by an intake valve 10 and an exhaust valve 11, respectively.

Intake air is introduced into the cylinders 4 through an intake passage 12 including, in order, from its upstream end to its downstream end, a common intake pipe 13, a surge tank 14, and left and right branch intake pipes 15 and 16 branching off from the surge tank 14. The left branch intake pipe 15 is connected to the intake ports 8 of each cylinder 4 of the left cylinder bank 2. The right branch intake pipe 16 is connected to the intake ports 8 of each cylinder 4 of the right cylinder bank 3. The intake passage 12 is provided, from its upstream end, with an air cleaner 17 at the upstream end of the common intake pipe 13, an output control means, such as a throttle valve 18, at the downstream end of the common intake pipe 13, and an air flow meter 19 between the air cleaner 17 and the throttle valve 18. The engine body 1 is further provided with a fuel injector 20, facing the intake port 8, for each cylinder 4.

An exhaust passage 22 is connected to each exhaust port 9 of the engine body 1 and is formed by left and right independent exhaust pipes 23 and 24 and a common exhaust pipe 25, which the downstream ends of the left and right independent exhaust pipes 23 and 24 form by coming together and joining. The left independent exhaust pipe 23 is connected to the exhaust port 9 of each cylinder 4 of the left cylinder bank 2. The right independent exhaust pipe 24 is connected to the exhaust port 9 of each cylinder 4 of the right cylinder bank 3. A rhodium catalytic converter (CCRO) 26 is installed in the common exhaust pipe 25 to significantly lower emission levels of pollutants such as hydrocarbons, carbon monoxide, and oxides of nitrogen. Air-fuel ratio sensors 27 and 28 are installed in the independent exhaust pipes 23 and 24, respectively.

The engine depicted in FIG. 1 is controlled by a control unit 50 comprising, for example, a microcomputer 40. The control unit 50 receives various signals from the air flow meter 19, the air-fuel ratio sensors 27 and 28, and from other sensors such as a temperature sensor 29 for detecting the temperature of engine coolant, a throttle opening sensor 30 for detecting the opening of the throttle valve 18, and an engine speed sensor 31 for detecting the speed of rotation of a crank shaft 32 and, therefore, the speed of rotation of the engine. As is well known, the air-fuel ratio sensors 27 and 28 detect the emission levels of oxygen in exhaust gases and provide signals representative of the levels of oxygen in these exhaust gases.

The control unit 50, receiving these various signals from the sensors 27 to 31, performs an air-fuel ratio feedback control. In such an air-fuel ratio feedback control, a basic fuel injection rate is established from a map of basic fuel injection rate, such as that schematically represented in FIG. 2, of intake air flow rate and engine speed. Then, a feedback correction value CFB is determined, based on the signals from the air-fuel ratio sensors 27 and 28, and is added to the basic fuel injection rate to provide the injector 20 with a fuel supply pulse which has a pulse period or width corresponding to the proper fuel injection rate.

The feedback correction value CFB is established for the injector 20 for each cylinder bank 2 or 3 during what is known as a "dual" feedback control. That is, the feedback control is performed independently for the left and right cylinder banks 2 and 3.

Figure 3:
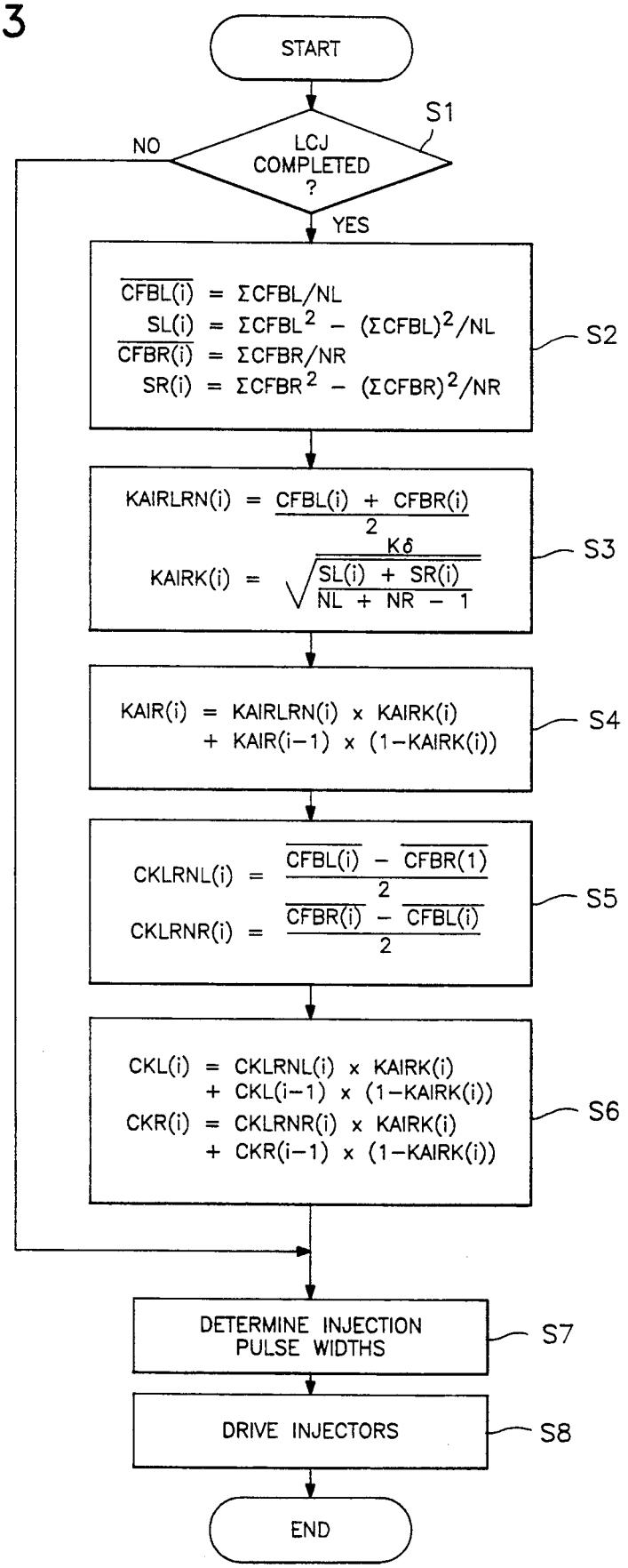
FIG. 3 is a flow chart illustrating an air-fuel ratio feedback control routine.

The operation of the engine depicted in FIG. 1 is best understood by reviewing FIG. 3, which is a flow chart illustrating a feedback control routine for the microcomputer 40. Programming a computer is a skill well understood in the art. The following description is written to enable a programmer having ordinary skill in the art to prepare an appropriate program for the microcomputer 40. The particular details of any such program would, of course, depend upon the architecture of the particular computer selected.

Figure 4A:
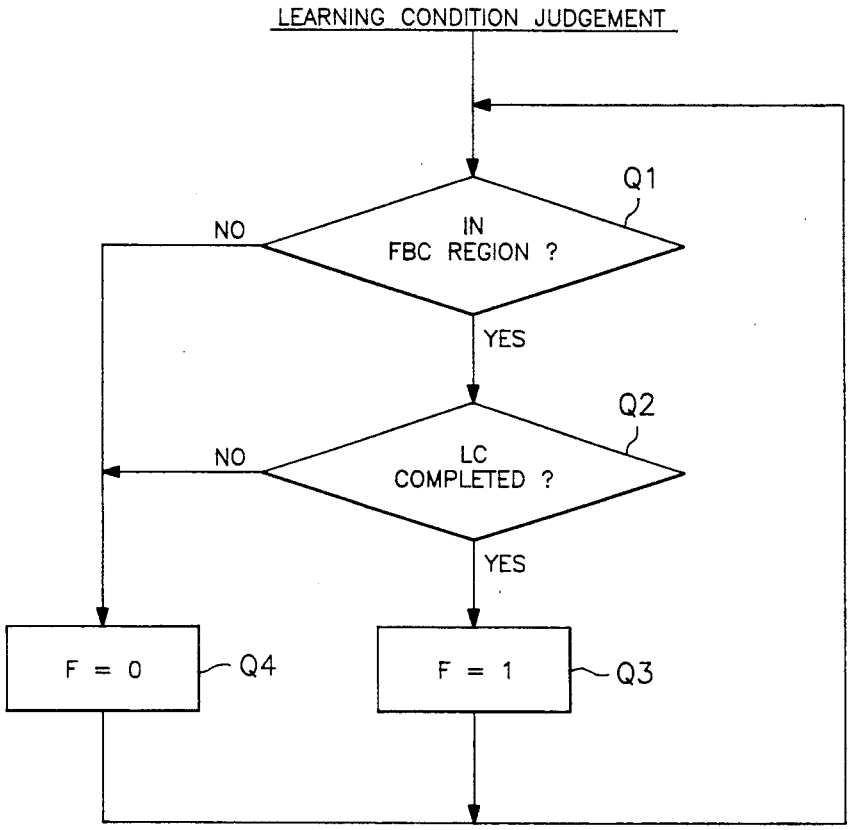
FIG. 4A is a flow chart illustrating an engine operating condition learning sequence.
Figure 5:
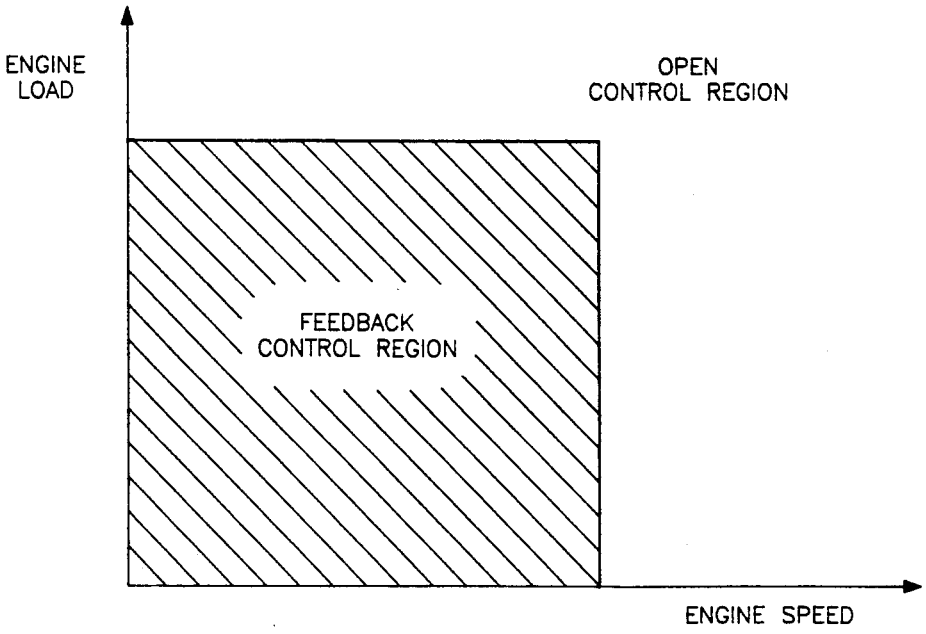
FIG. 5 is a diagram showing a feedback control region defined by engine load and engine speed as is shown in FIG. 5.

Referring to FIG. 3, the first step of the routine is to determine if a learning condition judgment is on-going at step S1. The determination of whether or not the learning condition judgment is on-going is made by the sequence represented by a flow chart shown in FIG. 4A. That is, decisions are made at step Q1 as to whether the engine is operating in a feedback control (FBC) region and at step Q2 as to whether the learning condition (LC) is completed. The feedback control region is defined by engine load and engine speed as is shown in FIG. 5. Engine load and engine speed are determined based on signals from the throttle opening sensor 30 and the engine speed sensor 31, respectively. The learning condition is determined to be completed when, for example, the temperature of engine coolant, which is detected by the temperature sensor 29, is above a predetermined specific temperature. If the answers to both the decisions made in steps Q1 and Q2 are yes, a feedback control flag F is set to "1" at step Q3. On the other hand, if one of the answers to either of the decisions is no, the feedback control flag F is set to "0" at step Q4. The sequence represented by the flow chart shown in FIG. 4 is periodically repeated After the determination made in step S1 has been completed, and if the answer to the decision is yes, mean values CFBL(i) and CFBR(i) and square sums SR(i) and SL(i) of the feedback correction values CFB are obtained for the cylinders 4 of the left and right cylinder banks 3 and 2, respectively, at step S2. These mean values CFBL(i) and CFBR(i) and square sums SL(i) and SR(i) are calculated from several feedback correction values CFBL and CFBR consecutively sampled NL and NR times, respectively.

Figure 4B:
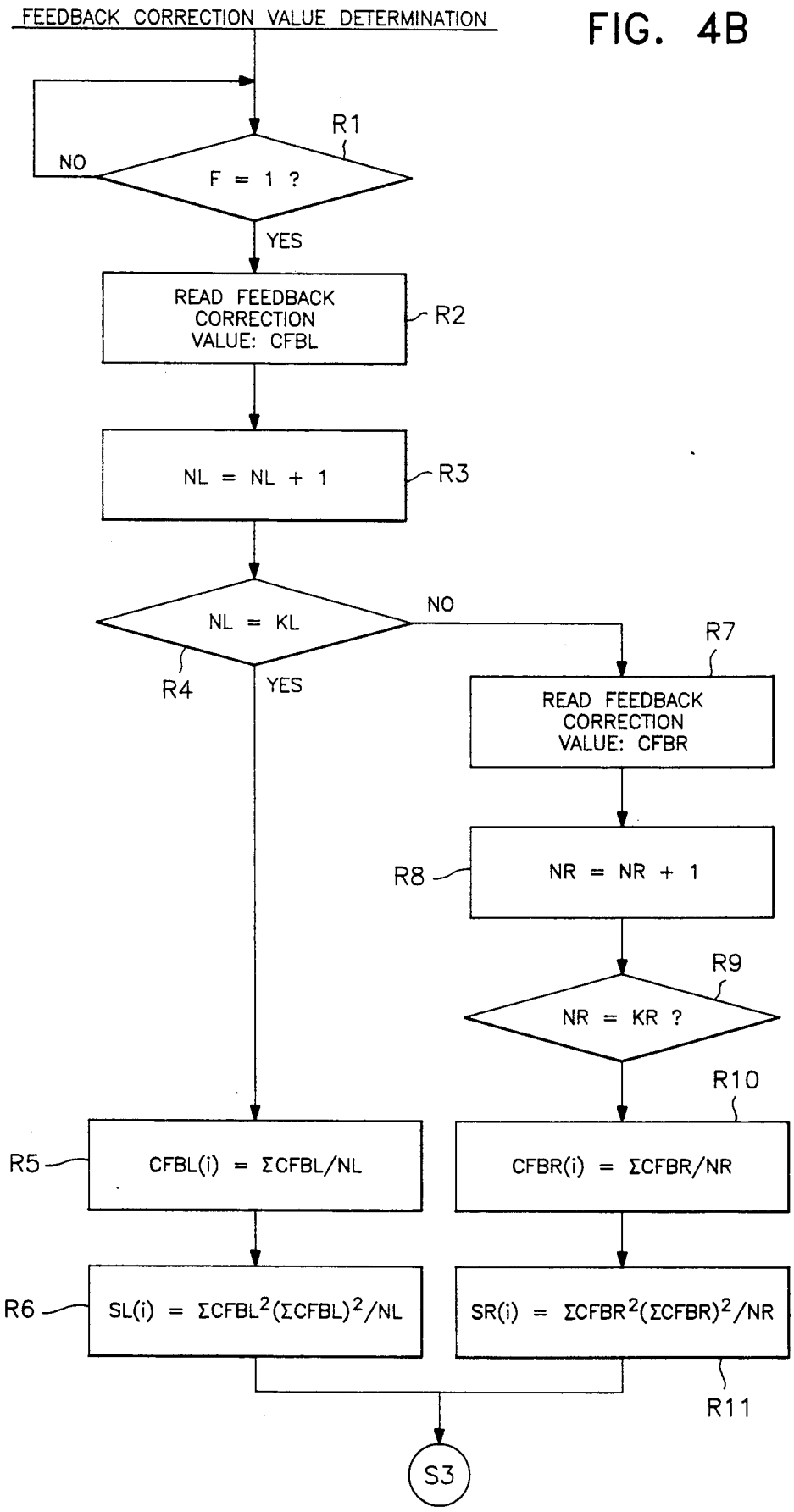
FIG. 4B is a flow chart illustrating a mean value and square sum calculation subroutine.

Referring to FIG. 4B, which is a flow chart illustrating the mean value and square sum calculation subroutine, the first step R1 in FIG. 4B is to make a decision as to whether the feedback control flag F has been set to "1". The decision is repeated until the answer becomes yes. If the answer to the decision is yes, this indicates that the engine is operating in a learning feedback control condition. Then, a feedback correction value CFBL for the cylinders 4 of the left cylinder bank 2 is retrieved from a map at step R2. It should be noted that feedback correction values CFBL and CFBR are values which are predetermined, in a conventional manner, from a data map for appropriate variables stores in a memory of control unit 50. After increasing the sampling number NL by one increment at step R3, a decision is made at step R4 as to whether the sampling number NL is equal to a predetermined number KL. If the answer to the decision made in step R4 is yes, that is, a predetermined number KL of feedback correction values CFBL has been sampled, then, a mean feedback correction value CFBL(i) is calculated from the predetermined number KL of feedback correction values CFBL at step R5. Then, a square sum SL(i) is calculated in the manner represented at step R6.

If the answer to the decision made in step R4 regarding the sampling number of feedback correction values CFBL for the cylinders 4 of the left cylinder bank 2 is no, then a feedback correction value CFBR for the cylinders 4 of the right cylinder bank 3 is retrieved at step R7. After counting or changing the sampling number NR by one increment at step R8, a decision is made at R9 as to whether the sampling number NR is equal to a predetermined number KR. If the answer to this decision is yes, that is, the predetermined number KL of feedback correction values CFBR has been sampled, then, a mean feedback correction value CFBR(i) is calculated from the predetermined number KL of feedback correction values CFBL at step R10. Then, a square sum SR(i) is calculated in the manner represented at step R11. However, if the answer to the decision regarding the number of sampling the feedback correction values CFBR for the cylinders 4 of the left cylinder bank 3 is no, then, the first decision at step R1 is repeated.

The sampling numbers NL and NR of the feedback correction values are different because although the learning condition is the same for the cylinders 4 of the left and right cylinder banks 2 and 3, the learning of the feedback correction value is not always performed at the same timing for the cylinders 4 of the left and right cylinder banks 2 and 3, due to various factors. The square sums SL(i) and SR(i), each of which is what is known as "dispersion" in the field of statistics, are used to obtain a coefficient KAIRK(i).

Referring back to FIG. 3, calculations are made at step S3 to obtain an extrapolated value KAIRLRN(i) representative of a change in air-fuel ratio due to an output error of the air flow meter 19 and the coefficient KAIRK(i). The extrapolated value KAIRLRN(i) representative of the change in air-fuel ratio is given as an arithmetical mean of the mean feedback correction values CFBL and CFBR for the cylinders 4 of the left and right cylinder banks 2 and 3. The coefficient KAIRK(i), used to consider the degree of influence of the extrapolated value KAIRLRN(i) on determining a learning correction value KAIR(i), which will be described later, is calculated from the following equation:

$$KAIRK(i) = Kd/\sqrt{[SL(i) + SR(i)]/(NL + NR - 1)},$$

wherein Kd is an experimentally determined, fixed standard value.

At step S4, the learning correction value KAIR(i) for the fuel injection rate, based on the extrapolated value KAIRLRN(i) representative of the change in air flow rate due to an output error of the air flow meter 19, is calculated from the following equation:

$$KAIR(i)=KAIRLRN(i)\times KAIRK(i)+KAIR(i-1)\times[(1-KAIRK(i)],$$

wherein (i) represents the present cycle, and (i − 1) represents the previous cycle.

The learning correction value KAIR(i), found at step S4, is added, as a correction rate based on the extrapolated value KAIRLRN(i) representative of the change in air flow rate due to an output error of the air flow meter or sensor 19, to the basic fuel injection rate obtained based on an air flow rate determined by the air flow sensor 19.

Thereafter, the learning process is performed at steps S5 and S6 to obtain a correction value based on errors in characteristics of the injectors 20 for the cylinders 4 of the left and right cylinder banks 2 and 3. That is, variables CKLRNL(i) and CKLRNR(i), representing changes in air-fuel ratios which are considered to originate in the injectors 20 for the cylinders 4 of the left and right cylinder banks 2 and 3, respectively, are calculated at step S5. These variables CKLRNL(i) and CKLRNR(i) accompany the correction made relating to the change in air flow rate due to an output error of the air flow meter 19 at steps S3 and S4. The learning correction value KAIR(i) has been added, as a correction rate based on the extrapolated value KAIRLRN(i) of change in air flow rate due to an output error of the air flow meter 19, to the basic fuel injection rate. Consequently, learning correction values CKL(i) and CKR(i), based on the extrapolated value KAIRLRN(i) representative of the change in air flow rate peculiar to the left and right injectors 20, respectively, of the left and right banks 2 and 3, are learned, based on the basic fuel injection rate added to the learning correction value KAIR(i) at step S6 from the following equations:

$$CKL(i)=CKLRNL(i)\times KAIRK(i)+CKL(i-1)\times[1-KAIRK(i)]:$$

and $$CKR(i)=CKLRNR(i)\times KAIRK(i)+CKR(i-1)\times[1-KAIRK(i)].$$

After the calculation of the learning correction values CKL(i) and CKR(i), it is possible, for example, to add the learning correction value CKL(i) to the feedback correction value CFBL, and the learning correction value CKR(i) to the feedback correction valve CFBR. The sums then maybe used, in a known manner, to determine desired injection pulse widths in step S7. As is clear, injection pulse widths are calculated at step S7 based on virtual injection rates obtained from a correction of the basic fuel injection rate with the use of the learning correction values CKL(i) and CKR(i) and the feedback correction values CFBL and CFBR, individually and independently, for the injectors 20 of the right cylinder bank 2 and the left cylinder bank 3. Finally, the injectors 20 for each of the left and right cylinder banks 2 and 3 are driven with a drive pulse having the calculated pulse width to inject fuel at the virtual fuel injection rate at step S8.

In the embodiment described above, the mean correction values of the feedback correction values for the left and right cylinder banks 2 and 3 are initially used to correct the basic fuel injection rate. Once the air flow meter 19 has aged somewhat, the learning correction values, peculiar to the left and right cylinder banks 2 and 3, respectively, will become significant. Since these learning correction values are individually added to the corrected basic fuel injection rate, the feedback correction values do not become excessive, even if the air flow meter 19 deteriorates due to aging.

As is apparent from the above description, even if an output error of the means for detecting intake air flow rate becomes large, the engine control system of the present invention can decrease demands on the feedback control for the air-fuel ratio.

It is to be understood that although the present invention has been described in detail with respect to a preferred embodiment thereof, various other embodiments and variants may occur to those skilled in the art which fall within the scope and spirit of the invention. Such other embodiments and variants are intended to be covered by the following claims.

What is claimed is:

1. An engine control system for an internal combustion engine equipped with first and second air-fuel ratio feedback control systems for first and second groups of injectors, each air-fuel ratio feedback control system feedback controlling a fuel injection rate, for each of said first and second groups of injectors, based on an air flow rate detected by an air flow meter common to said first and second cylinder groups, said engine control system comprising:

first air-fuel ratio sensor means for detecting an air-fuel ratio related value for the first air-fuel ratio feedback control system;

second air-fuel ratio sensor means for detecting an air-fuel ratio related value for the second air-fuel ratio feedback control system; and control means for determining feedback correction values for a fuel injection rate, based on the air-fuel ratio related values for the first and second air-fuel ratio feedback control systems, for obtaining a mean feedback correction value of said feedback correction values, for correcting the air flow rate, based on said mean feedback correction value, and for determining a virtual fuel injection rate, based on a corrected air flow rate for each group of injectors.

2. An engine control system as recited in claim 1, wherein each of said feedback correction values for the air-fuel ratio feedback control systems comprises an arithmetic mean value of a predetermined number of said air-fuel ratio related values.

3. An engine control system as recited in claim 2, wherein said air flow rate is corrected, based on said mean feedback correction value and a standard variation of a square sum of said predetermined number of said air-fuel ratio related values, for the first and second air-fuel ratio feedback control systems.

4. An engine control system as recited in claim 3, wherein said air flow rate is corrected less as said standard variation becomes larger.

5. An engine control system as recited in claim 4, wherein said air flow rate is corrected based on said mean feedback correction value and a standard variation of a mean value of said square sum.

6. An engine control system as recited in claim 1, wherein each of said air-fuel ratio sensor means comprises a sensor for detecting an emission level of oxygen in exhaust gases.

* * * * *